United States Patent [19]

Steinbrecher et al.

[11] 4,275,578

[45] Jun. 30, 1981

[54] APPARATUS FOR MANUFACTURING TUBES BY CONTINUOUS HOT ROLLING

[75] Inventors: Heinrich Steinbrecher, Meerbusch; Johannes Koch, Krefeld; Manfred Peglan, Duisburg, all of Fed. Rep. of Germany

[73] Assignee: Wean United, Inc., Pittsburgh, Pa.

[21] Appl. No.: 36,920

[22] Filed: May 7, 1979

[30] Foreign Application Priority Data

May 10, 1978 [DE] Fed. Rep. of Germany ..... 2820865

[51] Int. Cl.[3] ..... B21B 37/00; B21B 17/04

[52] U.S. Cl. ..... 72/14; 72/208; 72/234

[58] Field of Search ..... 72/208, 14, 15, 234, 72/235, 244, 224, 209

[56] References Cited

U.S. PATENT DOCUMENTS

| | | | |
|---|---|---|---|
| 3,864,951 | 2/1975 | Gulgaev et al. | 72/209 X |
| 3,874,211 | 4/1975 | Hagashi | 72/208 |

*Primary Examiner*—Milton S. Mehr

*Attorney, Agent, or Firm*—Daniel Patch; Suzanne Kikel

[57] ABSTRACT

A method and apparatus in a hot multi-stand tube mill for producing a thin metallic tube having end portions which corresponds to the wall thickness and diameter of the rest of the rolled tube or alternately, tapered ends. Each stand is provided with a set of three cooperating rolls arranged to form a roll pass opening. According to the tube's positioning in the mill, an appropriate additional adjustment of the rolls to decrease or enlarge the roll pass diameter is made in one or all of the last three stands. Both an initial roll setting varying means and an additional roll setting varying means cause movement of wedges abutting the roll chocks thereby causing movement of the rolls.

11 Claims, 4 Drawing Figures

APPARATUS FOR MANUFACTURING TUBES BY CONTINUOUS HOT ROLLING

The invention relates to a process and apparatus for manufacturing tubes or pipes from metallic shells by continuous hot rolling in a multistand rolling mill via a mandrel rod inserted into the shell. The invention especially deals with the so-called push bench, which has been part of the technology for a long time as exemplified in German Pat. DT-PS 911 365. In this well-known process a hot shell is pushed by a bar (which also is the inner tool, and therefore the mandrel) in several stands positioned in tandem and is stretched by rolling into a tube. The inner diameter of this tube depends for the most part on the outer diameter of the mandrel, the outer diameter of the tube on the roll pass diameter of the last stands which are used as sizing stands. A push bench is normally coupled with a piercing press which produces a hollow shell with an end closed for the push bench. Coupled at the outlet side of the piercing press is for instance a bottle reducing mill.

Operational experience with tube push benches shows that the produced tubes have a tendency to have an increased wall thickness toward the tail of the shell. Thin walled tubes especially show this increased wall thickness clearly. According to measurements taken at a plant which produces 14 m long tubes, the average wall thickness at the tube end was approximately 0.1 mm more than at the front end of the tube. It is therefore very likely that this problem increases as the length and weight of the tube increases.

An object of this invention is to provide a means and process for hot rolling tubes where the wall thickness at the tail section can be regulated and which is designed especially to eliminate such wall thickness increases.

According to the present invention during rolling of a shell the roll pass diameter of one or more of the last few stands are changed by adjusting the rolls. One object is attained if it is being compensated by this adjustment starting at the time where a wall thickness increase would occur. This can be the case after the tail end of the shell leaves the first stand. It is therefore suggested according to a further development of the invented process that the roll pass diameter of each of the last stands is gradually reduced after the tail end of the shell leaves the first rolling stand. This reduction in the stands is done simultaneously, but to different degrees, i.e., more additional adjustment is done in the last stand in the mill than in the stands up from the last stand.

The invented process has a further object, namely of deliberately producing tubes with tapered ends. Thus a further development of the invention provides that the adjustable stands start out with a small roll pass diameter that is increased to the wall thickness of a rolled tube after the front end of the shell leaves the last adjustable stand. The tail end of the tube by a reverse procedure is rolled with a tapered end also. The produced tubes with tapered ends are subsequently processed in a stretch reduction mill whereby crop losses due to heavy ends in this mill, namely the stretch reducing mill, are decreased.

To accomplish this novel process a continuous tube rolling mill is suitable, especially a push bench where the rolls of the last stands can be adjusted in unison with reference to rolling or forming the end portions of the tube in addition to the normal adjustment of each stand with reference to the other portion of the tube or shell.

The unisonal adjustment can be controlled by a transmitter such as a photo cell tracing or detecting directly or indirectly the rolling position of the shell within the stands.

The registering of the positioning of the shell can be done by different ways and means, such as a rotary cam type limit switch built in at the main drive of the bar or mandrel. Another way of indirectly registering the position of the shell would be to adjust the appropriate stands in relation to rolling pressures which can be measured at the previous stand. Accordingly, there exists a way to compensate deviations from average wall thicknesses of shells entering the first stand by adjusting the last or sizing stands.

It is advantageous in many cases to proceed according to the development of the invention which provides that the adjustment time of the adjusting mechanism is nearly as much as the transport time of the tail of the shell through the stands equipped with additional adjustment mechanisms to effect a variation in the rolling of the end portions. In other cases a programmed control would be suitable. With this program, material dependent influences such as type of material could easily be compensated.

These objects as well as other novel features and advantages of the present invention will be better understood when the following description of the preferred embodiments are read along with the accompanying drawings of which:

Figure 4:
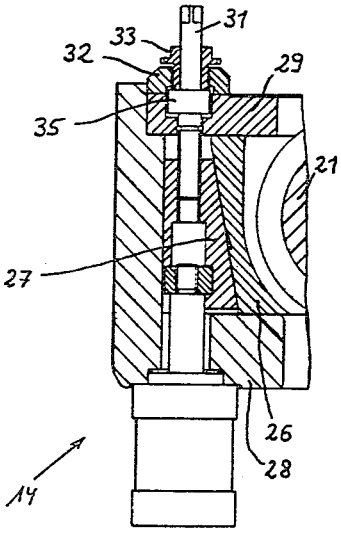
FIGS. 3 and 4 show partial sections taken on lines AB of FIG. 2.
Figure 3:
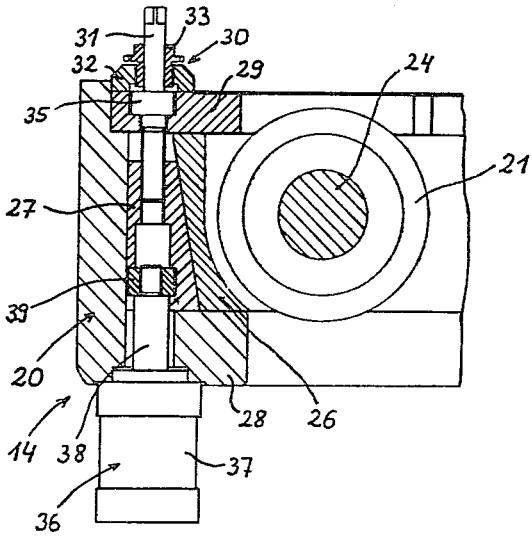

FIG. 3 illustrating the initial roll setting position, and FIG. 4 the roll setting for effecting a rolling of the end portion of the shell.

Figure 1:
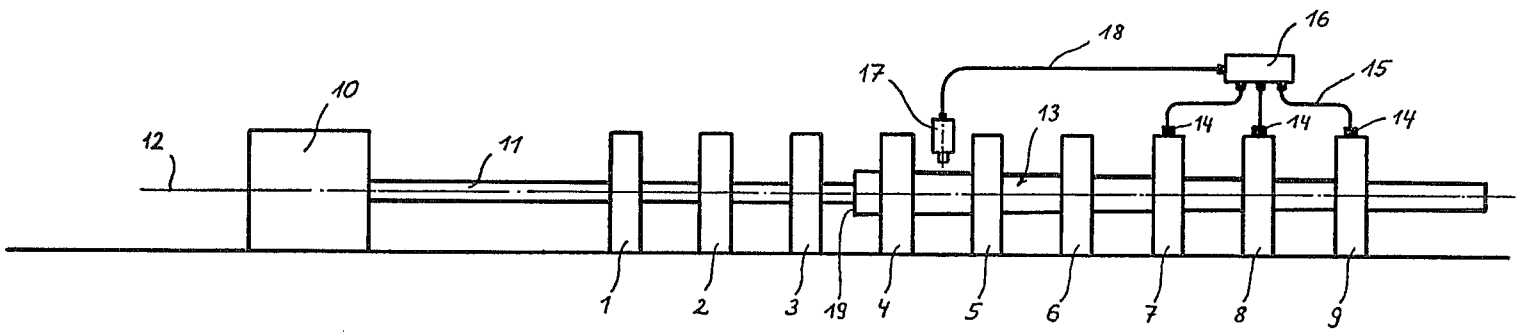
FIG. 1 shows in schematic form a tube push bench.

The push bench shown in FIG. 1 has nine stands 1–9 positioned in tandem and a pushing device 10 for mandrel 11. The pushing device 10 is moved during rolling with the mandrel 11 toward stands 1–9. The last stands of the push bench (7, 8, 9), which normally are sizing stands, are equipped with adjusting mechanism 14 for additionally adjusting the rolls. The adjusting mechanism 14 is connected via control lines 15 with the control equipment 16 and a transmitter 17 is wired to a tramsmitter line 18. The transmitter 17 can be a photo cell or a mechanical tracer which responds to passing of the tail end 19 of the shell 13. A dash-and-dot line 12 indicates the pass line.

Figure 2:
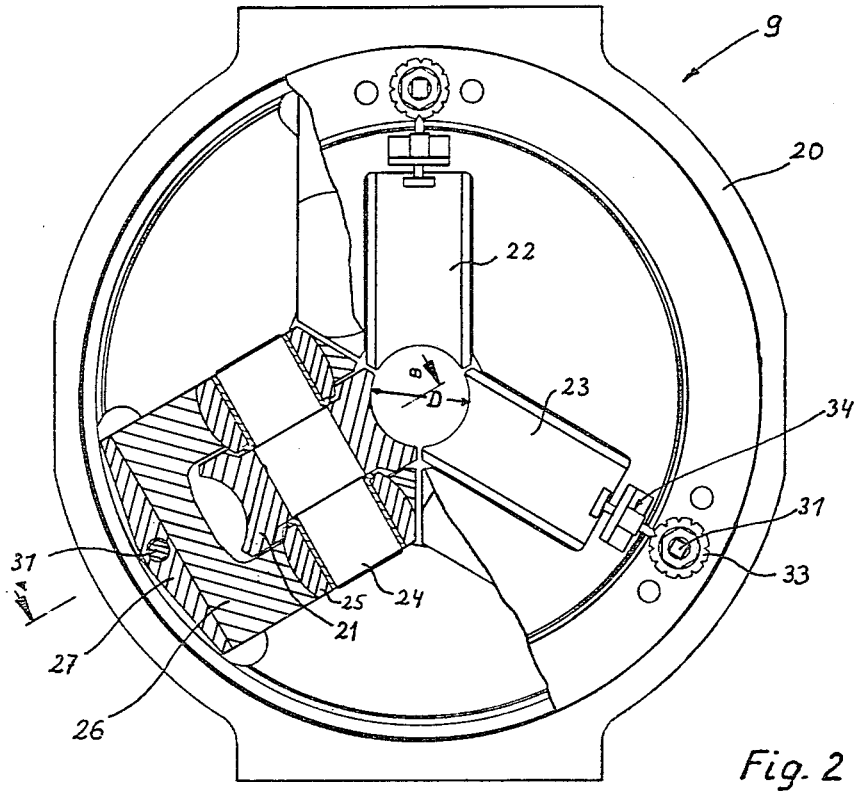
FIG. 2 shows a partial sectional front view of one of the three roll sizing stands shown in FIG. 1.

FIG. 2 shows a three roll stand, for instance the last three roll stand 9. It consists mainly of a ring-shaped housing 20, where three non-driven rolls 21, 22, 23 are located in bearings 25. The rolls 21, 22, 23 form the roll pass with a roll pass diameter D. The rolls 21, 22, 23 understandably may not touch each other. Rather they have between them a small gap which changes during the additional adjustment but does not completely disappear.

The bearings 25 of roll 21 can be seen in a partial section. The roll 21 is supported on a shaft 24 which is positioned by bearings 25 in a chock 26, and where the chock 26 is supported via a wedge element 27 on the housing 20. Further details given in FIG. 2 will be explained in describing FIGS. 3 and 4.

FIGS. 3 and 4 basically shown the same details but different adjustment positions of the additional adjusting mechanism 14.

FIG. 3 shows that the housing 20 has flange 28 extending in the direction of the pass line. On the other side of housing 20 another ring flange 29 is attached (detachable) to be able to assemble the roll head. Parts 28 and 29 serve to position and guide the chock 26 which has a tapered outer surface. The taper of this outer surface coincides with the taper of the wedge 27 in which chock 26 is caused to move toward and away from the roll pass by a basic adjustment mechanism 30 and the additional adjustment mechanism 14.

The basic or primary adjustment mechanism 30 mainly consists of an adjusting spindle supported directly on the housing 20. The threaded part of the adjusting spindle is engaged with wedge 27. During turning of the adjusting spindle 31, the wedge 27 adjusts accordingly. Opposed abutments are provided for the adjusting spindle 31, one being formed by the ring flange 29 shown best in FIG. 3 where a collar 35 engages flange 29, and the other being formed by an adjustable threaded sleeve 33 threadedly received by an intermittent part 32. In FIG. 4 the collar 35 has been vertically displaced from its position shown in FIG. 3 and engages the bottom of sleeve 33. The axial extension of the collar 35 is less than the distance of the inner bottom surface of the threaded sleeve 33 from the corresponding opposed surface of the ring flange 29. Therefore, the collar 35 and therefore also the adjusting spindle 31 have a certain clearance or freedom to move vertically. The end positions of this clearance is adjustable and as noted, can be locked in a certain setting by device 34 shown in FIG. 2. These end positions can be seen in FIGS. 3 and 4, also the appropriately different positions of the wedge 27.

This clearance is necessary for the adjusting mechanism 14 to function which mechanism 14 consists of an hydraulic operating piston cylinder 36. Its cylinder 37 is connected to the housing 20 and its piston is connected to the wedge 27 via a coupling 39. The hydraulic operating cylinder 36 is double acting and quick operating. It retains the wedge 27 either in the position shown in FIG. 3 or in FIG. 4. The position shown in FIG. 4 is according to a reduction of the roll pass diameter D as opposed to the roll pass diameter D resulting from the position shown in FIG. 3.

FIG. 3 also shown that each roll 21, 22, 23 must be individually coordinated with an appropriate hydraulic operating cylinder 36.

The second embodiment of the present invention provides for a transmitter detecting the leading end of the shell. This mode can be easily provided for in the control system illustrated in FIG. 1 by arranging a transmitter 17 downstream of the stand 9 to detect the leading end of the shell leaving the last stand and transmitting the signal to control 16 for prompt action.

The following is a brief description of the first of two operations of the invention. With reference to FIG. 3 the basic adjusting mechanism 31 has already initially adjusted the roll gap through the rotation of spindle 31 translating an upward or downward movement to wedge 27 and therefore a lateral movement of roll 21 toward or away from the pass line of roll pass diameter. During this movement the piston in piston cylinder assembly 36 is free to move. In this FIG. 3 a clearance between part 32 and collar 35 is set by sleeve 33. When the roll pass diameter is to be further reduced the transmitter 17 detecting the trailing end of the tube travelling through the first stands transmits a signal to control 16 which then activates piston cylinder assembly 36 to further force wedge 27 upward thereby taking up clearances between part 32 and collar 35. This condition is shown in FIG. 4.

To produce a leading tapering end, i.e., where the roll pass diameter is relatively small and is to be increased after the leading end leaves the last stand, mechanisms 14 and 30 are in the position shown in FIG. 4. Piston cylinder assembly 36 is advanced in the opposite direction of that above described causing wedge 27 to be moved downwardly causing clearances between flange 29 and collar 35 and clearances between wedge 27 and flange 28 to be taken up as shown in FIG. 3. The positioning of wedge 27 against chock 26 allows the next portion of shell to force the rolls to the left as one views FIGS. 3 and 4, thereby increasing the roll pass diameter. The same essential procedure, but in reverse, can be used for producing a trailing tapered end.

It will be appreciated that if, for example three sizing stands are being employed, the roll pass diameter formed by the rolls of these stands will progressively increase or decrease with reference to rolling the trailing end to obtain a uniform wall thickness on the leading and trailing end to effect a tapering, depending on which condition is being experienced.

In accordance with the provisions of the patent statutes, we have explained the principle and operation of our invention and have illustrated and described what we consider to represent the best embodiment thereof.

We claim:

1. A continuous hot tube rolling mill having several stands arranged in tandem and wherein a mandrel is insertable in a shell having a leading and a trailing end and wherein said mandrel and said shell are pushed between a plurality of rolls in said stands, said rolls of each stand forming a rolling area in which said shell is rolled, the mill further comprising:

a housing for each stand, a chock assembly for rotatably supporting each said roll in said housing, means for adjusting the setting of each roll for at least one stand, including displaceable means constructed and arranged to be in contact with each said chock assembly, and having a first adjusting means for displacing said displaceable means to obtain a desired initial rolling area for said one stand and a second adjusting means constructed and arranged to cooperate with said first adjusting means for further displacing said displaceable means to obtain a desired additional rolling area for at least one stand, means for actuating said first and second adjusting means, and a transmitter means for detecting a predetermined rolling position of said shell while passing through said stands and for controlling said actuating means of said second adjusting means to adjust in unison said rolls of said one stand to effect said further adjusting of said roll setting.

2. A continuous hot tube rolling mill according to claim 1, wherein there is provided a said adjustment means for the last stand or stands, and said second means quickly adjusts said rolls in said last stand or stands shortly before said trailing end of said shell enters said rolling area of each of said last stand or stands.

3. A continuous hot tube rolling mill according to claim 2, wherein there is provided a said adjusting means for the last stand or stands, and said second means includes means for effecting said quick adjustment of said rolls of said last stand or stands in a manner to gradually decrease said rolling area starting at the first stand and continuing to the last stand of said last stands.

4. A continuous hot tube rolling mill according to claim 1 wherein there is provided a said adjustment means for the last stand or stands, and said second means quickly adjusts said rolls in said last stand or stands shortly after said leading end of said shell leaves said rolling area of said last stand of said mill.

5. A continuous hot tube rolling mill according to claim 4 wherein there is provided a said adjusting means for the last stand or stands, and said second means includes means for effecting said quick adjustment of said rolls in a manner to increase said rolling area of said last stand or stands to a wall thickness of a desired diameter for said tube, which rolling area is relatively small when compared with said desired diameter for said tube.

6. A continuous hot tube rolling mill according to claim 1 wherein said transmitter means includes a photo cell.

7. A continuous hot tube rolling mill according to claim 1; wherein said housing of said one stand further comprises:

a first ring flange and a second ring flange defining the sides of said housing and located on either side of said chock assembly of each said rolls in said stand, said chock assembly for each said roll in said housing having a tapered surface on the side outwardly of said rolling area;

wherein said displaceable means comprises a wedge element for each chock assembly having a tapered surface coinciding with and abutting said tapered surface of said chock assembly; and, wherein said first adjusting means for each chock assembly is constructed and arranged relative to said first flange in a manner to impart movement to said associated wedge element, and said second adjusting means for each chock assembly is constructed and arranged relative to said second ring flange in a manner to impart said further movement to said associated wedge element.

8. A continuous hot tube rolling mill according to claim 7 wherein said wedge element has internal threads;

wherein said first adjusting means further consists of:

a threaded spindle extending from and through said first ring flange and engaging with said internal threads of said wedge element, a collar mounted around said spindle and extending into said first ring flange, means for allowing and adjusting the amount of said further movement for said wedge element which movement corresponds to a movement of said collar in said first ring flange; and wherein said second adjusting means further consists of:

an hydraulic piston cylinder assembly having a cylinder connected to and extending from said second ring flange, and a piston extending into said wedge element opposite to and aligned with said spindle.

9. A continuous hot tube rolling mill having several stands arranged in tandem and wherein a mandrel is insertable in a shell having a leading and a trailing end and wherein said mandrel and said shell are pushed between a plurality of rolls in said stands, said rolls for each stand forming a rolling area in which said shell is rolled, the mill further comprising:

a housing for each stand, a chock assembly for rotatable supporting each said roll in said housing, means for adjusting the roll setting to obtain a desired initial rolling area for at least one stand and for further adjusting said roll setting to obtain a desired additional rolling area for the said one stand, said housing of said last stands further comprises:

a first ring flange and a second ring flange defining the sides of said housing and located on either side of said chock assembly of each said rolls in said stand, said chock assembly for each said roll in said housing having a tapered surface on the side outwardly of said rolling area, a wedge element for each chock assembly having a tapered surface coinciding with and abutting said tapered surface of said chock assembly, said adjusting means includes first and second means for each said roll, said first adjusting means constructed and arranged relative to said first flange in a manner to impart movement to said wedge element, said second adjusting means constructed and arranged relative to said second ring flange in a manner to impart said further movement to said wedge element, means for actuating said first and second adjusting means.

10. A continuous hot tube rolling mill according to claim 9, wherein said wedge element has internal threads;

wherein said first adjusting means further consists of:

a threaded spindle extending from and through said first ring flange and engaging with said internal threads of said wedge element, a collar mounted around said spindle and extending into said first ring flange, means for allowing and adjusting the amount of said further movement for said wedge element which movement corresponds to a movement of said collar in said first ring flange; and wherein said second adjusting means further consists of:

an hydraulic piston cylinder assembly having a cylinder connected to and extending from said second ring flange, and a piston extending into said wedge element opposite to and aligned with said spindle.

11. A continuous hot tube rolling mill according to claim 1, wherein said first and said second adjusting means are arranged in an opposed manner, and each having portions connected to said displaceable means.

* * * * *